US005099934A

United States Patent [19]

Barr

[11] Patent Number: 5,099,934

[45] Date of Patent: Mar. 31, 1992

[54] ROTARY DRILL BITS

[76] Inventor: John D. Barr, 2 Charlton Park Gate, Cheltenham Gloucestershire, England

[21] Appl. No.: 616,637

[22] Filed: Nov. 21, 1990

[30] Foreign Application Priority Data

Nov. 25, 1989 [GB] United Kingdom ..... 8926689

[51] Int. Cl.[5] ..... E21B 10/60; E21B 10/56

[52] U.S. Cl. ..... 175/393; 175/399; 175/400; 175/408; 175/426

[58] Field of Search ..... 175/393, 399, 400, 329, 175/374, 376, 408, 325

[56] References Cited

U.S. PATENT DOCUMENTS

| | | | |
|---|---|---|---|
| 2,931,630 | 4/1960 | Grady | 175/400 X |
| 3,215,215 | 11/1965 | Kellner | 175/393 X |
| 3,455,402 | 7/1969 | Tirospolsky | 175/393 X |
| 3,908,771 | 9/1975 | Garrett | 175/393 |
| 3,923,109 | 12/1975 | Williams, Jr. | 175/376 X |
| 4,463,220 | 7/1984 | Gonzalez | 175/343 |
| 4,982,802 | 1/1991 | Warren et al. | 175/325 X |

FOREIGN PATENT DOCUMENTS

| | | |
|---|---|---|
| 2167107 | 5/1986 | United Kingdom . |
| 80/02858 | 12/1980 | World Int. Prop. O. . |
| 89/02023 | 3/1989 | World Int. Prop. O. . |

OTHER PUBLICATIONS

"Bit Whirl-A New Theory of PDC Bit Failure", paper No. SPE 15971, by J. F. Brett, T. M. Warren and S. M. Behr, Society of Petroleum Engineers, 64th Annual Technical Conference, San Antonio, Texas, Oct. 8-11, 1989.

"Development of a Whirl Resistant Bit", paper No. 19572, by T. M. Warren, Society of Petroleum Engineers, 64th Annual Technical Conference, San Antonio, Texas, Oct. 8-11, 1989.

*Primary Examiner*—Stephen J. Novosad
*Attorney, Agent, or Firm*—Browning, Bushman, Anderson & Brookhart

[57] ABSTRACT

A rotary drill bit comprises a bit body having a shank for connection to a drill string and a passage for supplying drilling fluid to the face of the bit, which carries a plurality of polycrystalline diamond preform cutting elements. In order to reduce bit whirl, the cutting elements are so disposed as to apply a resultant lateral imbalance force to the bit as it rotates during drilling and the gauge of the bit body is provided with low friction bearing pads to transmit said resultant lateral force to the sides of the borehole. Each low friction bearing pad includes an outwardly facing cavity which is connected to the passage by a choked conduit so that, in use, drilling fluid under pressure is delivered to the cavity, which thereby acts as a low friction hydrostatic bearing surface.

18 Claims, 2 Drawing Sheets

ROTARY DRILL BITS

BACKGROUND OF THE INVENTION

The invention relates to rotary drill bits for use in drilling or coring holes in subsurface formations, and particularly to polycrystalline diamond compact (PDC) drag bits.

A rotary drill bit of the kind to which the present invention relates comprises a bit body having a shank for connection to a drill string and a passage for supplying drilling fluid to the face of the bit, which carries a plurality of preform cutting elements each formed, at least in part, from polycrystalline diamond. One common form of cutting element comprises a tablet, usually circular or part-circular, made up of a superhard table of polycrystalline diamond, providing the front cutting face of the element, bonded to a substrate which is usually of cemented tungsten carbide.

The bit body may be machines from solid metal, usually steel, or may be moulded using a powder metallurgy process in which tungsten carbide powder is infiltrated with metal alloy binder in a furnace so as to form a hard matrix.

While such PDC bits have been very successful in drilling relatively soft formations, they have been less successful in drilling harder formations and soft formations which include harder occlusions or stringers. Although good rates of penetration are possible in harder formations, the PDC cutters suffer accelerated wear and bit life can be too short to be commercially acceptable.

Recent studies have suggested that the rapid wear of PDC bits in harder formations is due to chipping of the cutters as a result of impact loads caused by vibration, and that the most harmful vibrations can be attributed to a phenomenon called "bit whirl". ("Bit Whirl—A New Theory of PDC Bit Failure"—paper No. SPE 15971 by J. F. Brett, T. M. Warren and S. M. Behr, Society of Petroleum Engineers, 64th Annual Technical Conference, San Antonio, Oct. 8-11, 1989). Bit whirl arises when the instantaneous axis of rotation of the bit processes around the central axis of the hole when the diameter of the hole becomes slightly larger than the diameter of the bit. When a bit begins to whirl some cutters can be moving sideways or backwards relatively to the formation and may be moving at much greater velocity than if the bit were rotating truly. Once bit whirl has been initiated, it is difficult to stop since the forces resulting from the bit whirl, such as centrifugal forces, tend to reinforce the effect.

Attempts to inhibit the initiation of bit whirl by constraining the bit to rotate truly, i.e. with the axis of rotation of the bit coincident with the central axis of the hole, have not been particularly successful.

Although it is normally considered desirable for PDC drill bits to be rotationally balanced, in practice some imbalance is tolerated. Accordingly it is fairly common for PDC drill bits to be inherently imbalanced, i.e. when the bit is being run there is, due to the cutting, hydraulic and centrifugal forces acting on the bit, a resultant force acting on the bit, the lateral component of which force, during drilling, is balanced by an equal and opposite reaction from the sides of the borehole.

This resultant lateral force is commonly referred to as the bit imbalance force and is usually represented as a percentage of the weight-on-bit since it is almost directly proportional to weight-on-bit. It has been found that certain imbalanced bits are less susceptible to bit whirl than other, more balanced bits. ("Development of a Whirl Resistant Bit"—paper No. SPE 19572 by T. M. Warren, Society of Petroleum Engineers, 64th Annual Technical Conference, San Antonio, Oct. 8-11, 1989). Investigation of this phenomenon has suggested that in such less susceptible bits the resultant lateral imbalance force is directed towards a portion of the bit gauge which happens to be free of cutters and which is therefore making lower "frictional" contact with the formation than other parts of the gauge of the bit on which face gauge cutters are mounted. It is believed that, since a comparatively low friction part of the bit is being urged against the formation by the imbalance force, slipping occurs between this part of the bit and the formation and the rotating bit therefore has less tendency to process, or "walk", around the hole, thus initiating bit whirl.

(Although, for convenience, reference is made herein to "frictional" contact between the bit gauge and formation, this expression is not intended to be limited only to rubbing contact, but should be understood to include any form of engagement between the bit gauge and formation which applies a restraining force to rotation of the bit. Thus, it is intended to include, for example, engagement of the formation by any cutters or abrasion elements which may be mounted on the part of the gauge being referred to.)

This has led to the suggestion, in the above-mentioned paper by Warren, that bit whirl might be reduced by omitting cutters from one sector of the bit face, so as deliberately to imbalance the bit, and providing a low friction pad on the bit body for engaging the surface of the formation in the region towards which the resultant lateral force due to the imbalance is directed.

Experimental results have indicated that this approach may be advantageous in reducing or eliminating bit whirl. However, the omission of cutters from one sector of a PDC bit can have disadvantages, and our co-pending British Patent Application No. 8926688-6 discloses some alternative and preferred arrangements for providing the necessary imbalance in the bit in an arrangement for reducing or eliminating bit whirl. The present invention relates to arrangements for providing the necessary low friction pad on the bit body. The arrangements to be described may provide a low friction pad for use with any method of providing the imbalance force, including but not restricted to those arrangements disclosed in the above mentioned co-pending application.

SUMMARY OF THE INVENTION

According to the invention there is provided a rotary drill bit comprising a bit body having a shank for connection to a drill string and a passage for supplying drilling fluid to the face of the bit, which carries a plurality of preform cutting elements each formed, at least in part, from polycrystalline diamond, the bit including means to apply a resultant lateral imbalance force to the bit as it rotates in use, and the gauge of the bit body including at least one low friction bearing pad so located as to transmit said resultant lateral force to the part of the formation which the bearing pad is for the time being engaging, the low friction bearing pad including an outwardly facing cavity, conduit means being provided which place the cavity in communication with the aforesaid passage in the bit body whereby, in use, drilling fluid under pressure is delivered to said cavity.

Said conduit means preferably include at least one restrictor to provide a pressure drop in the drilling fluid delivered through said conduit means to the cavity. For example, the restrictor may comprise a series of chokes.

Preferably there is provided a second low friction bearing pad so located as to transmit part of said resultant lateral force to the formation. The centres of pressure of the two low friction bearing pads are preferably angularly spaced apart on the forward and rearward sides respectively of the direction of said resultant lateral imbalance force with respect to the normal direction of forward rotation of the drill bit while drilling, and, in a plane transverse to the longitudinal axis of the drill bit. The centre of pressure of the bearing pad on the forward side of the lateral imbalance force is preferably angularly spaced from said direction by a lesser angle than is the centre of pressure of the bearing pad on the rearward side of said direction.

The centres of pressure of the two bearing pads may be angularly spaced apart, in a plane transverse to the longitudinal axis of the drill bit, by an angle in the range of about 50° to 100°.

The angular separation of the outer extremities of the two bearing pads, in a plane transverse to the longitudinal axis of the drill bit, is preferably greater than 80° and less than 180°.

Where two bearing pads are provided, each of the pads may include an outwardly facing cavity, with conduit means placing the cavity in communication with said passage in the bit body. Alternatively only one of said low friction bearing pads may include an outwardly facing cavity and conduit means placing the cavity in communication with said passage in the bit body, said second bearing pad providing a solid bearing surface. In this case the pad which includes an outwardly facing cavity is preferably disposed on the leading side of the second bearing pad with respect to the normal direction of forward rotation of the drill bit while drilling.

In any of the above arrangements the outer surface contour of each bearing pad preferably substantially conforms to the contour of a portion of the surface of revolution generated by the cutting elements on the bit body.

The invention includes within its scope a rotary drill bit having a shank for connection to a drill string and a passage for supplying drilling fluid to the face of the bit, which carries a plurality of cutting elements, the bit body having a gauge portion which includes a plurality of outwardly facing cavities spaced apart around the periphery of the drill bit, conduit means being provided for placing each cavity in communication with the aforesaid passage in the bit body whereby, in use, drilling fluid under pressure is delivered to said cavity.

There may, for example, be provided four outwardly facing cavities spaced apart substantially symmetrically around the periphery of the drill bit.

DETAILED DESCRIPTION OF THE PREFERRED EMBODIMENTS

Figure 1:
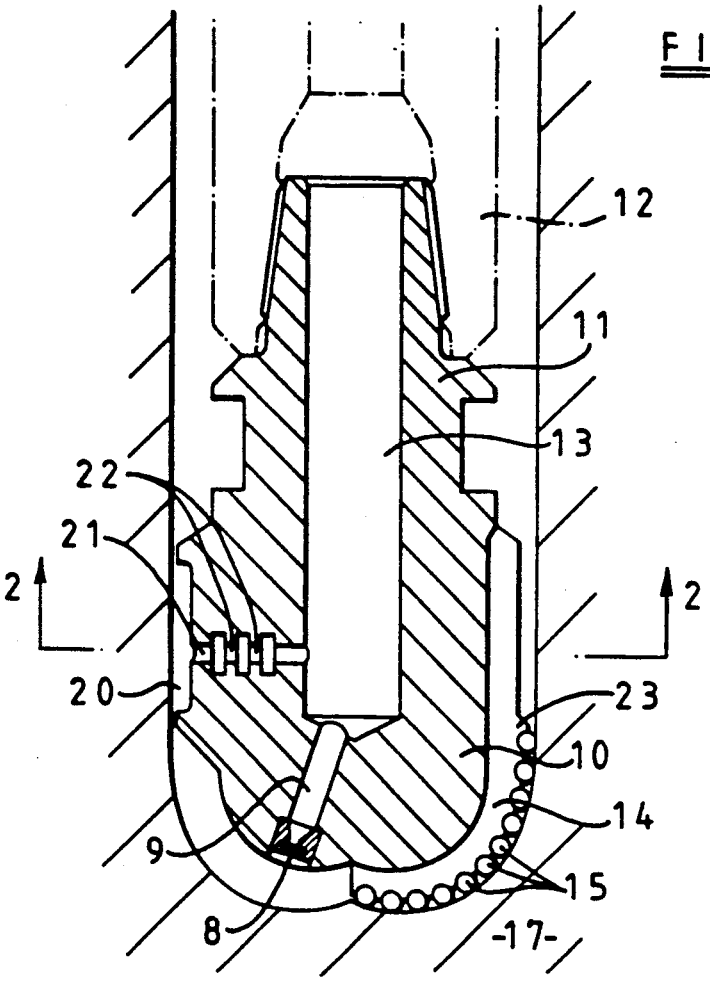
FIG. 1 is a diagrammatic longitudinal section through one form of PDC drill bit, shown downhole, in accordance with the invention.
Figure 2:
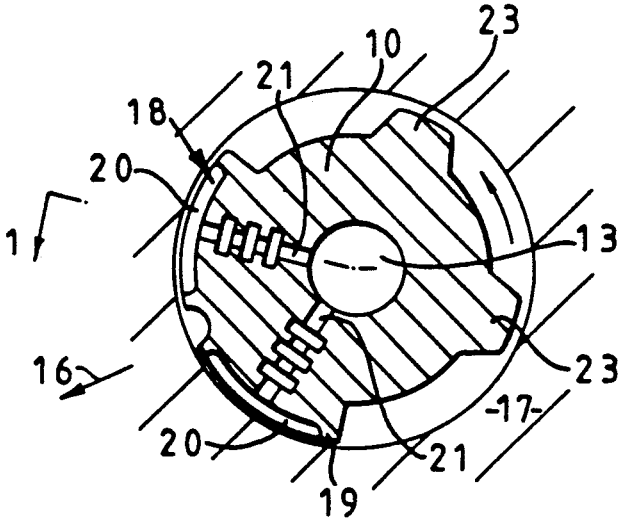
FIG. 2 is a horizontal section on the line 2—2 of FIG. 1, FIGS. 3–6 are similar diagrammatic horizontal sections through alternative forms of drill bit according to the invention.

Referring to FIGS. 1 and 2, there is shown a rotary drill bit comprising a bit body 10 having a shank 11 for connection to a drill string 12 and a central passage 13 for supplying drilling fluid through bores 9 to nozzles 8 in the face of the bit.

The face of the bit is formed with at least one blade 14 which carries a plurality of preform cutting elements 14 each formed, at least in part, from polycrystalline diamond.

The bit is imbalanced, i.e. it is so designed that when the bit is being run there is a resultant force having a lateral component acting sideways on the bit which, during drilling, is balanced by an equal and opposite reactive force from the walls of the borehole. In the bit shown in FIGS. 1 and 2 the imbalance force is provided by locating the majority of the cutters 15 to one side of a diameter of the bit body, for example by providing cutters along only a single blade. The direction of the resultant lateral imbalance force is indicated by the arrow 16 in FIG. 2. However, such arrangement is described merely by way of example and any suitable means may be employed for achieving this imbalance force and the present invention is not restricted to the use of any particular method of achieving such force.

In accordance with the previously mentioned concept of reducing or eliminating bit whirl, the gauge portion of the bit body is provided with low friction bearing pads to transmit the imbalance force 16 to the formation 17. In accordance with the present invention there are provided one or more low friction bearing pads each comprising an outwardly facing cavity in a gauge portion of the bit body, a conduit being provided which places the cavity in communication with the passage 13 in the bit body whereby, in use, drilling fluid under pressure is delivered to the cavity. The fluid-filled cavity thus acts, essentially, as a low friction hydrostatic bearing.

In the particular arrangement shown in FIGS. 1 and 2, there are provided two such hydrostatic bearing pads 18 and 19 which are angularly spaced apart in a plane transverse to the central longitudinal axis of the drill bit, and are disposed on the forward and rearward sides respectively of the direction of the imbalance force 16 as used herein, and unless otherwise noted, terms such as "forward," "rearward," "leading," and "trailing" will refer to the normal direction of forward rotation of the drill bit while drilling, as indicated by the curved arrows in the various transverse cross-sectional views of the drawings.

Each bearing pad comprises a shallow cavity 20 which communicates with the central passage 13 of the drill bit by means of a conduit 21 formed with a series of chokes 22. The provision of a series of chokes allows greater internal diameter of the conduit to prevent blockage, for a required pressure drop. Other forms of restrictors could also be used.

The centres of pressure of the two pads are angularly spaced apart by approximately 70°, although other angular spacings in the range of 50° to 100° may also be suitable. The angular spacing should be sufficient to allow for variations in the direction of the imbalance force 16 due, for example, to manufacturing tolerances and variation in operating conditions.

The bearing pads 18, 19 are so disposed that the resultant of the reaction forces between the bearing pads and the walls of the boreholes, during drilling, balances the lateral imbalance force 16 acting on the drill bit. Since each reaction force includes a small rearward tangential component, therefore, the bearing pads are not symmetrically disposed with respect to the direction of the imbalance force 16 but are slightly displaced rearwardly from the symmetrical position. Accordingly, the centre of pressure of the bearing pad 19 on the forward side of the direction of the imbalance force 16 is angularly displaced therefrom by a lesser angle than the centre of pressure of the rearward pad 18.

For effective operation, the angular separation of the outer extremities of the two bearing pads, in a plane transverse to the longitudinal axis of the drill bit, should be less than 180°, and in the arrangement shown is approximately 120°. Preferably this angular separation is greater than 80°.

When pressurised with drilling fluid the cavities 20 act in effect as hydrostatic bearing pads to reduce the frictional engagement of the bit body with the surface of the formation 17. As previously mentioned, the sideways imbalance force acting on the drill bit during drilling is normally a percentage of the weight-on-bit. It will be appreciated that the open area of each cavity and the pressure therein should be so calculated as to provide sufficient reactive force on the walls of the borehole to balance the sideways imbalance force applied to the bit. This then serves to maintain the rest of the gauge portion around the cavity out of engagement with the formation, providing a gap through which drilling fluid flows from the cavity to the annulus.

The bit body is formed with kickers 23 disposed diametrically opposite the bearing pads 18 and 19 respectively to assist in guiding and stabilising the bit during tripping in and out of the borehole. As will be seen from FIG. 2, however, there is a gap between the kickers 23 and the walls of the borehole during drilling.

Although it is preferred to provide two hydrostatic bearing pads disposed forward and rearwardly of the direction of the imbalance force, any number of such bearing pads may be provided so long as they are so located as to transmit to the surface of the formation at least a portion of the imbalance force acting on the bit during drilling. Preferably all the effective bearing pads on the bit are hydrostatic bearing pads in accordance with the present invention, but arrangements are possible in which hydrostatic bearing pads in accordance with the invention are provided in combination with the forms of low friction bearing pads, as will be described below.

Figure 3:
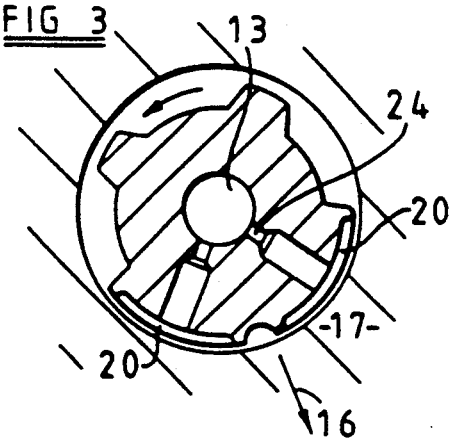
Figure 4:
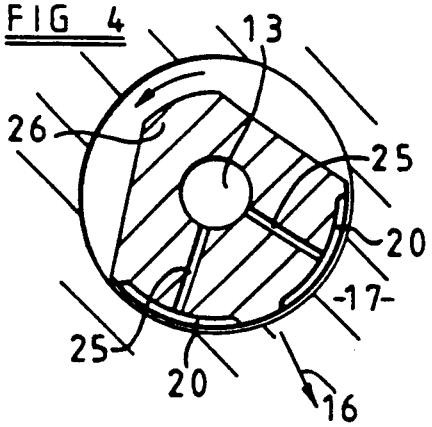
Figure 5:
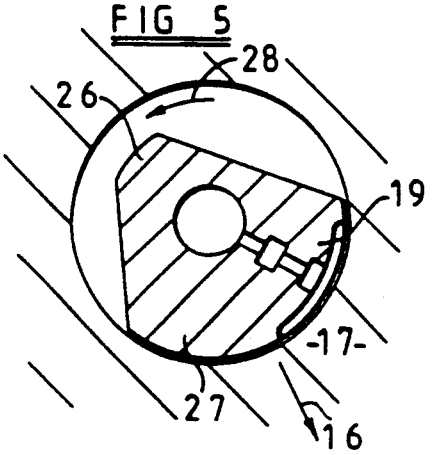

FIGS. 3 to 5 show diagrammatically modifications of the arrangement shown in FIGS. 1 and 2 and corresponding parts are given the same reference numerals. In the arrangement of FIG. 3 the series of chokes 22 of FIGS. 1 and 2 are replaced by a single choke 24 which is located adjacent the central passage 13 to create the necessary pressure drop. It will be appreciated that a similar effect would be achieved by providing a single choke adjacent each cavity 20.

In the alternative arrangement shown in FIG. 4 the necessary pressure drop is created by connecting each cavity 20 to the central passage 13 by a capillary bore 25 which is of restricted area along its entire length. In the FIG. 4 arrangement also, the bit body is provided with a single kicker 26 opposite and symmetrical with respect to the cavities 20.

FIG. 5 shows diagrammatically an alternative arrangement in which an hydrostatic bearing pad 19, in accordance with the present invention, is combined in the bit body with a bearing pad 27 having a low friction solid bearing surface engaging the wall of the borehole. As in the previous arrangements the two bearing pads are disposed forwardly and rearwardly of the direction of the lateral imbalance force 16, and in this case also the bit body is formed with a single kicker 26 on the opposite side of the bit body from the bearing pads.

In FIG. 5 the direction of rotation of the drill bit (looking upwardly from below) is indicated by the arrow 28. It will thus be seen that the hydrostatic bearing pad 19 is on the leading side of the bearing pad 27 with respect to the direction of rotation of the drill bit. Such configuration is preferred in the case where the two types of bearing pad are combined.

The provision of only a single hydrostatic bearing pad, as in FIG. 5 may reduce the use of drilling mud for the bearings, leaving more mud available for cleaning and cooling the face of the bit.

In all of the arrangements described above, the hydrostatic bearing pads are provided on cylindrical portions of the bit gauge. However this is not essential, and such pads may be provided on other parts of the bit body, engaging the formation, which may be of other shapes. For example the pads may be provided on a tapered portion of the bit body. Preferably the outer configuration of each bearing pad is such as substantially to conform to the contour of the corresponding portion of the surface of revolution generated by the cutting elements on the bit body, so that the bearing pad, in turn, conforms to the surface of the formation over which it passes.

Figure 7:
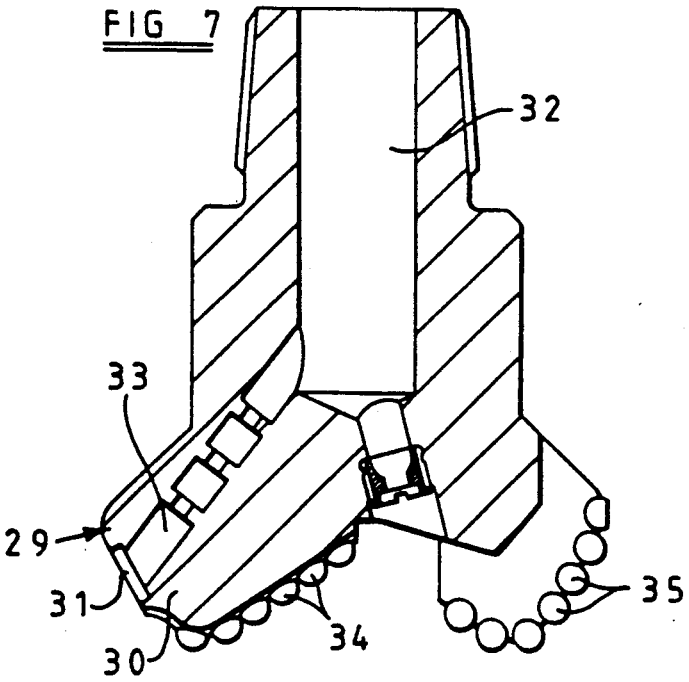
FIG. 7 is a diagrammatic longitudinal section through a still further form of drill bit in accordance with the invention.

FIG. 7 shows diagrammatically an arrangement in which an hydrostatic bearing pad 29 is provided on a tapered, part-conical portion 30 of an alternative form of drill bit and comprises a cavity 31 which communicates with the central passage 32 through a conduit 33 formed with a series of chokes. In this case also two such bearing pads re symmetrically disposed to transmit the resultant lateral imbalance force on the drill bit to the wall of the borehole. The imbalance force is created by the disposition of the cutting elements 34 and 35 on the bit body.

The hydrostatic bearing pads in accordance with the invention have been described in relation to imbalanced drill bits designed to reduce or eliminate bit whirl. However, there may also be advantage, in conventional PDC drill bits, in using a similar arrangement to reduce the frictional engagement between the gauge of the bit and the surrounding walls of the borehole, for example in horizontal or high angle boreholes. It will be appreciated that reduction of the frictional engagement between the gauge portion of any drill bit and the surrounding formation may reduce the torque necessary to rotate the drill bit in the borehole, and may reduce the tendency for the bit to become unstable and vibrate. In such a conventional symmetrical drill bit a plurality of cavities would be arranged substantially symmetrically around the periphery of the bit, and the provision of the symmetrical bearing pads may also help to centralise the bit in an oversize hole. Such an arrangement is shown diagrammatically in FIG. 6.

Figure 6:
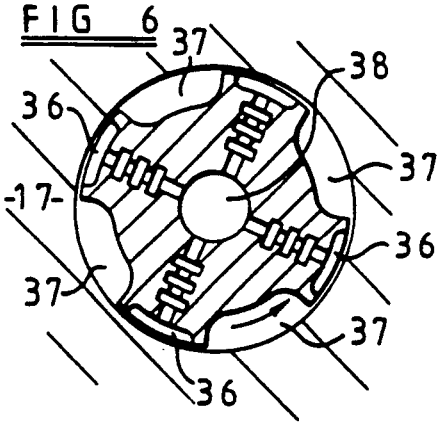

In the arrangement of FIG. 6, four cavities 36 are spaced equally around the bit body, junk slots 37 being provided between adjacent cavities. Each cavity 36 is connected to the central passage 38 for drilling fluid by a subsidiary choked passage 39.

In all the arrangements described above each bearing pad comprises a single cavity facing the walls of the borehole. However, the invention also includes within its scope arrangements where each bearing pad comprises two or more cavities, for example cavities spaced axially of the drill bit at the same, or different, angular locations.

I claim:

1. A rotary drill bit comprising a bit body having a shank for connection to a drill string and a passage for supplying drilling fluid to the face of the bit, which carries a plurality of preform cutting elements each formed, at least in part, from polycrystalline diamond, the bit including means to apply a resultant lateral imbalance force to the bit as it rotates in use, and the bit body including at least one low friction bearing pad so located as to transmit said resultant lateral force to the part of the formation which the bearing pad is for the time being engaging, the low friction bearing pad including an outwardly facing cavity, conduit means being provided which place the cavity in communication with the aforesaid passage in the bit body whereby, in use, drilling fluid under pressure is delivered to said cavity.

2. A rotary drill bit according to claim 1, wherein said conduit means include at least one restrictor to provide a pressure drop in the drilling fluid delivered through said conduit means to the cavity.

3. A rotary drill bit according to claim 2, wherein there is provided a series of chokes in said conduit means.

4. A rotary drill bit according to claim 1, wherein there is provided a second low friction bearing pad so located as to transmit part of said resultant lateral force to the formation.

5. A rotary drill bit according to claim 4, wherein the centres of pressure of the two low friction bearing pads are angularly spaced apart on the forward and rearward sides respectively, with respect to the normal direction of forward rotation of the drill bit while drilling, of the direction of said resultant lateral imbalance force, in a plane transverse to the longitudinal axis of the drill bit.

6. A rotary drill bit according to claim 5, wherein the centre of pressure of the bearing pad on the forward side of the lateral imbalance force, with respect to the normal direction of forward rotation of the drill bit while drilling, is angularly spaced from said direction by a lesser angle than is the centre of pressure on the bearing pad on the rearward side of said direction.

7. A rotary drill bit according to claim 5, wherein the centres of pressure of the two bearing pads are angularly spaced apart, in a plane transverse to the longitudinal axis of the drill bit, by an angle in the range of about 50° to 100°.

8. A rotary drill bit according to claim 4, wherein the angular separation of the outer extremities of the two bearing pads, in a plane transverse to the longitudinal axis of the drill bit, is less than 180°.

9. A rotary drill bit according to claim 8, wherein the angular separation of the outer extremities of the two bearing pads, in a plane transverse to the longitudinal axis of the drill bit, is greater than 80°.

10. A rotary drill bit according to claim 4, wherein each of said bearing pads includes an outwardly facing cavity, with conduit means placing the cavity in communication with said passage in the bit body.

11. A rotary drill bit according to claim 4, wherein only one of said low friction bearing pads includes an outwardly facing cavity and conduit means placing the cavity in communication with said passage in the bit body, said second bearing pad providing a solid bearing surface.

12. A rotary drill bit according to claim 11, wherein said bearing pad including an outwardly facing cavity is disposed on the leading side of the second bearing pad with respect to the normal direction of forward rotation of the drill bit while drilling.

13. A rotary drill bit according to claim 1, wherein the outer surface contour of each bearing pad substantially conforms to the contour of a portion of the surface of revolution generated by the cutting elements on the bit body.

14. A rotary drill bit according to claim 1, wherein said low friction bearing pad is disposed on a generally part-cylindrical portion of the bit body.

15. A rotary drill bit according to claim 1, wherein said low friction bearing pad is disposed on a generally tapered portion of the bit body.

16. A rotary drill bit having a shank for connection to a drill string and a passage for supplying drilling fluid to the face of the bit, which carries a plurality of cutting elements, the bit body having a gauge portion which includes a plurality of outwardly facing bearing pads spaced apart around the periphery of the drill bit, each bearing pad having an outer surface which, in use of the drill bit, bears against the surface of the formation being drilled, and each bearing pad including an outwardly facing cavity, conduit means being provided for placing each cavity in communication with the aforesaid passage in the bit body whereby, in use, drilling fluid under pressure is delivered to said cavity, each cavity being entirely surrounded by said outer surface of the bearing pad, whereby fluid delivered under pressure to the cavity may only escape outwardly from the cavity by leaking through a clearance between the surrounding outer surface of the bearing pad and the adjacent surface of the formation being drilled.

17. A rotary drill bit according to claim 16, wherein said outwardly facing cavities are substantially symmetrically spaced apart around the periphery of the drill bit.

18. A rotary drill bit according to claim 16, wherein there are provided four outwardly facing cavities spaced apart around the periphery of the drill bit.

* * * * *